United States Patent [19]

Teuscher et al.

[11] Patent Number: 4,582,772

[45] **Date of Patent: * Apr. 15, 1986**

[54] LAYERED PHOTOCONDUCTIVE IMAGING DEVICES

[75] Inventors: Leon A. Teuscher; Ian D. Morrison, both of Webster, N.Y.

[73] Assignee: Xerox Corporation, Stamford, Conn.

[ * ] Notice: The portion of the term of this patent subsequent to Mar. 27, 2001 has been disclaimed.

[21] Appl. No.: 466,764

[22] Filed: Feb. 15, 1983

[51] Int. Cl.[4] ..... G03G 5/00; G03G 5/04

[52] U.S. Cl. ..... 430/58; 430/59; 430/62; 430/64; 430/65; 430/69

[58] Field of Search ..... 430/58, 59, 62, 69, 430/64, 65

[56] References Cited

U.S. PATENT DOCUMENTS

| | | | |
|---|---|---|---|
| 3,394,001 | 7/1968 | Makino | 430/64 |
| 4,123,267 | 10/1978 | Dorer | 430/65 |
| 4,269,919 | 5/1981 | Kuehnle | 430/66 X |
| 4,369,242 | 1/1983 | Arimilli et al. | 430/64 X |
| 4,374,916 | 2/1983 | Lelental et al. | 430/62 X |
| 4,390,608 | 6/1983 | Hashimoto et al. | 430/59 X |
| 4,391,888 | 7/1983 | Chang et al. | 430/64 X |
| 4,439,507 | 3/1984 | Pan et al. | 430/59 |

*Primary Examiner*—John E. Kittle
*Assistant Examiner*—Mukund J. Shah
*Attorney, Agent, or Firm*—E. O. Palazzo

[57] ABSTRACT

This invention is directed to an improved photoresponsive device comprised in the order stated of (1) a substrate, (2) a transmissive semi-conductive layer selected from the group consisting of indium-tin oxide, cadmium tin oxide, tin oxide, titanium oxides, titanium nitrides, titanium silicides, and mixtures thereof (3) a photogenerating layer comprised of an inorganic photoconductive composition or an organic photoconductive composition, dispersed in a resinous binder and (4) a charge carrier transport layer comprised of a combination of a resinous binder having dispersed therein small molecules of an electrically active material, the combination of which is substantially non-absorbing to visible light and allows the injection of photogenerating holes from the charge photogenerating layer in contact therewith, the electrically active material being of the following formula:

wherein X is selected from the group consisting of ortho $CH_3$, meta $CH_3$, para $CH_3$, ortho Cl, and para Cl, as well as the incorporation of such devices in electrostatographic imaging systems.

38 Claims, 4 Drawing Figures

LAYERED PHOTOCONDUCTIVE IMAGING DEVICES

BACKGROUND

This invention generally relates to photoresponsive imaging devices, and more specifically, the present invention is directed to layered photoresponsive, or photosensitive imaging members containing a semi-conductive layer. In one embodiment of the present invention there is envisioned a layered photoresponsive device comprised of a semi-conductive layer, a photogenerating layer, and a charge transport layer. The layered photoresponsive imaging members of the present invention can be incorporated into numerous imaging devices, including xerographic imaging systems, wherein there is formed on these members, for example, electrostatic latent images, which images can subsequently be developed, and transferred to a suitable substrate.

The formation and development of electrostatic latent images on the surface of photoconductive materials, referred to in the art as photoreceptors or photosensitive compositions, is well known. In these imaging systems, and in particular in xerography, the xerographic plate containing the photoconductive insulating member is imaged by uniformly electrostatically charging its surface, followed by exposure to a pattern of activating electromagnetic radiation, such as light, which selectively dissipates the charge in the illuminated areas of the photoconductive member causing a latent electrostatic image to be formed in the non-illuminated areas. This latent electrostatic image can then be developed with developer compositions containing, for example, toner particles and carrier particles, followed by subsequently transferring this image to a suitable substrate such as paper. Many known photoconductive members can be selected for incorporation into the electrostatographic imaging system including for example, photoconductive insulating materials deposited on conductive substrates, as well as those containing a thin film barrier layer of aluminum oxide situated between the substrate and the photoconductive member. The barrier layer is included primarily for the purpose of preventing charge injection from the substrate into the photoconductive layer upon charging, as charge injection could adversely affect the electrical properties of the photoreceptor compositions involved.

Examples of photoconductive members include those comprised of inorganic materials and organic materials, layered devices of inorganic or organic materials, composite layered devices containing photoconductive substances dispersed in other materials, and the like. An example of one type of composite photoconductive layer used in xerography is described for example, in U.S. Pat. No. 3,121,006, wherein there is disclosed finely divided particles of a photoconductive inorganic compound dispersed in an electrically insulating organic resin binder. In one embodiment, the photoconductive composition is comprised of particles of zinc oxide uniformly dispersed in a resinous binder coated on a paper backing. Useful binder materials disclosed include those which are incapable of transporting for any significant distance injected charge carriers generated by the photoconductive particles. Accordingly, as a result the photoconductive particles must be in a substantially contiguous particle to particle contact throughout the layer for the purpose of permitting charge dissipation required for a cyclic operation. Thus, about 50 percent by volume of photoconductive particles is usually necessary in order to obtain sufficient photoconductor particle to particle contact for rapid discharge. These high photoconductive concentrations can result in destroying the physical continuity of the resin, thus significantly reducing the mechanical strength of the binder material.

Illustrative examples of specific binder materials disclosed in this patent include, for example, polystyrene resins, silicone resins, acrylic and methacrylic ester polymers, polymerized ester derivatives of acrylic and alpha-acrylic acids, chlorinated rubber, vinyl polymers and copolymers, and cellulose esters.

Other examples of other known photoconductive compositions include amorphous selenium, halogen doped amorphous selenium substances, amorphous selenium alloys, including selenium arsenic, selenium tellurium, selenium arsenic antimony, halogen doped selenium alloys, wherein the halogen is chlorine, iodine, fluorine, or bromine, present in amounts of 50 parts per million to about 1,000 parts per million; cadmium sulfide, and the like. Generally, these photoconductive materials are deposited on suitable conductive substrates, and incorporated into xerographic imaging systems for use as imaging members.

Recently, there has been disclosed layered photoresponsive devices comprised of photogenerating layers and transport layers, deposited on conductive substrates as described, for example, in U.S. Pat. No. 4,265,990, and overcoated photoresponsive materials containing a hole injecting layer, covercoated with a hole transport layer, a photogenerating layer and a top coating of an insulating organic resin, as described, for example in U.S. Pat. No. 4,251,612. Examples of photogenerating layers disclosed in these patents include trigonal selenium and various phthalocyanines, while examples of transport layers described include certain diamines dispersed in inactive polycarbonate resin materials. The disclosures of each of these patents, namely, U.S. Pat. No. 4,265,990 and U.S. Pat. No. 4,251,612 are totally incorporated herein by reference.

Additionally, there is disclosed in Belgium Pat. No. 763,540, an electrophotographic member having at least two electrically operative layers, the first layer comprising a photoconductive layer which is capable of photogenerating charge carriers, and injecting photogenerated holes into a continuous active second layer containing a transporting organic material which is substantially non-absorbing in the spectral region of intended use, but which is active in that allows the injection of photogenerating holes from the photoconductive layer and the transporting of these holes through the active layer.

Other representative patents disclosing layered photoresponsive devices include U.S. Pat. Nos. 3,401,116, 4,115,116, 4,047,949 and 4,081,274.

While the above-described photoresponsive devices are generally suitable for their intended purposes, there continues to be a need for improved imaging members, particularly layered members containing semi-conductive materials, photogenerating layers and transport layers, which devices not only generate acceptable images but which can be repeatedly used in a number of imaging cycles without deterioration thereof from the machine environment, or surrounding conditions. Additionally, there continues to be a need for improved layered imaging members containing transmissive semi-conductive layers, and improved binder compositions for the photogenerating layer, and/or charge transport layer. Furthermore, there continues to be a need for improved binder materials for layered devices containing generating layers and transport layers. Also, there continues to be a need for layered photoresponsive devices of improved mechanical strength which contain a semi-conductive ground plane layer. Improved layered photoresponsive devices wherein no adhesive layers are needed for binding the photogenerating layer to the substrate are also needed.

SUMMARY OF THE INVENTION

It is an object of the present invention to provide improved imaging devices which overcomes the above-noted disadvantages.

A further object of the present invention is the provision of an improved photoresponsive imaging device containing a highly transmissive semi-conductive layer.

It is another object of the present invention to provide an improved photoresponsive imaging member containing a semi-conductive layer, a photogenerating layer, and a transport layer.

In yet another object of the present invention there is provided a layered photoresponsive device containing an improved photogenerating layer comprised of photoconductive materials dispersed in a resinous binder of poly(hydroxyethers).

In yet another object of the present invention there is provided improved layered photoresponsive imaging devices containing a charge carrier transport layer dispersed in a resinous binder of poly(hydroxyether)resin.

An additional object of the present invention is the provision of an improved layered imaging device containing a poly(hydroxyether) binder for the photogenerating layer, and the charge carrier transport layer, which ether also possess adhesive characteristics.

These and other objects of the present invention are accomplished by the provision of an improved layered photoresponsive imaging device comprised of an optionally supporting substrate, a transmissive semi-conductive layer, a photogenerating layer, and a transport layer. More specifically, in one illustrative embodiment of the present invention there is provided an improved layered photoresponsive imaging device comprised of a substrate, a highly transmissive semi-conductive layer in contact with the substrate, a photogenerating layer comprised of inorganic or organic photoconductive compositions dispersed in a resinous binder, which photogenerating layer is in contact with the semi-conductive layer, and as a top layer, a charge carrier transport layer comprised of materials capable of transporting charge, dispersed in a resinous binder material. In one important embodiment of the present invention, the semi-conductive layer is comprised of an indium-tin oxide material, and the binder material for the photogenerating layer and transport layer are comprised of poly(hydroxyethers) derived from diphenols as more specifically illustrated hereinafter.

In a further alternative embodiment of the present invention there can be included in the photoresponsive device two optional layers, namely, an adhesive layer and known dielectric layers. The adhesive layer which is situated between the photogenerating layer and the highly transmissive semi-conductive layer is usually present when the poly(hydroxyether) is not selected as the resinous binder for the photogenerating layer, since these ethers also function as adhesives. The adhesive layer ranges in thickness of from about 0.02 microns to about 0.1 micron, and is comprised of well known materials which will function so as to substantially permanently bond the photogenerating layer to the semi-conductive layer. Illustrative examples of adhesive materials include polyvinylbutyral, polyvinylpyrolidone, polyesters, particularly those commercially available from E. I. duPont as polyesters 49,000, and the like. Other adhesive materials can be selected providing the objectives of the present invention are achieved.

The optional dielectric layer is also generally situated between the photogenerating layer and the semi-conductive layer and is comprised of known dielectric materials including aluminum oxides ($Al_2O_3$) silicon oxide, and the like. This layer generally ranges in thickness of from about 0.005 microns to about 1 to 2 microns and is preferably of a thickness of about 0.1 microns. This dielectric layer can also serve to substantially permanently bond the photogenerating layer to the semi-conductive layer.

Accordingly, in a further embodiment of the present invention, the improved photoresponsive device is comprised of the following layers in the order stated: (1) a supporting substrate, either insulating or conducting, (2) a transmissive semi-conductive layer, (3) a dielectric layer, (4) a photogenerating layer comprised of inorganic or organic photoconductive compositions dispersed in a resinous binder, and (5) as a top layer, a charge carrier transport layer comprised of materials capable of transporting charge dispersed in a resinous binder. Additionally, the improved photoresponsive device of the present invention can be comprised of a supporting substrate, either insulating or conducting, a transmissive semi-conductive layer in contact therewith, a dielectric layer in contact with the with the semi-conductive layer, an adhesive layer overcoated on the dielectric layer, a photogenerating layer comprised of inorganic or organic photoconductive compositions dispersed in a resinous binder, which photogenerating layer is in contact with the adhesive layer, and as a top layer, a charge carrier transport layer comprised of materials capable of transporting charge, dispersed in a resinous binder material. The improved photoresponsive device of the present invention may also contain a supporting substrate, a highly transmissive semi-conductive layer, an adhesive layer, photogenerating layer, and a charge transport layer.

The photoresponsive imaging devices of the present invention can be incorporated into xerographic imaging systems wherein electrostatic latent images are formed thereon, the imaging process usually involving charging, optical projection, exposure, and development, as described for example in U.S. Pat. No. 4,265,990.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
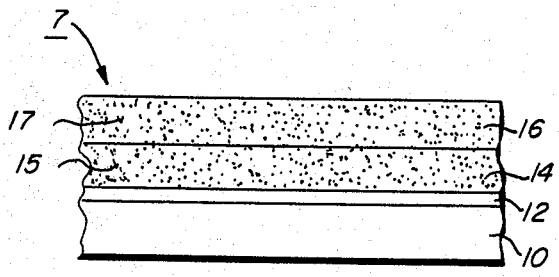
FIG. 1 is a partially schematic cross-sectional view of the photoresponsive imaging device of the present invention.

Illustrated in FIG. 1 is an example of the photoresponsive imaging member of the present invention generally designated 7, comprising an optional insulating or conductive supporting substrate 10, a layer of transmissive semi-conductive material 12, a photogenerating layer 14, comprised of a photoconductive charge carrier photogenerating material dispersed in a resinous binder 15, and a charge carrier transport layer 16, comprised of a charge carrier transport material dispersed in a resinous binder 17.

Substrate 10 which may be opaque or substantially transparent can be comprised of a number of numerous suitable insulating or conductive materials possessing, for example, the requisite mechanical properties. Accordingly, substrate 10 may comprise a layer of an insulating material such as an inorganic or organic polymer material, examples of which include thermoplastic substances, selected for example, from polycarbonates, polyurethanes, polyesters, polyamides, and the like. A particularly useful insulating substrate layer is one that is comprised of a polymer of polyethylene terephthalate, commercially available as Mylar®. Examples of conductive materials useful as the supporting substrate include aluminum, chromium, nickel, and the like. The conductive material can in one embodiment of the present invention be deposited on a flexible substrate. The substrate 10 may be flexible or rigid and may have many different configurations, such as for example, a plate, a cylindrical drum, a scroll, an endless flexible belt, and the like. Preferably, substrate 10 is in the form of an endless flexible belt.

The thickness of the substrate layer depends on many factors including economical considerations, generally, however, this layer may be of substantial thickness, for example, over 200 microns, or of minimum thickness, for example about 25 microns, providing there are no adverse affects on the system. More specifically, the thickness of this layer ranges from about 50 microns to about 150 microns, and preferably is of a thickness of from about 75 microns to about 125 microns. Substrate layers having thicknesses outside these ranges can be used providing the objectives of the present invention are accomplished.

The transparent semi-conductive layer 12 in contact with layer 10 can be comprised of numerous semi-conductive materials including for example, indium-tin oxide which is highly transparent, cadmium-tin oxide, tin oxide, titanium oxides, titanium silicides, titanium nitrides, and the like. The preferred semi-conductive material, because of its extremely high transparency properties is indium-tin oxide, which material has a substantially 100 percent transmitting value as compared to almost zero transmittance for most conductor materials, like aluminum of a comparable thickness. The semi-conductive materials selected for layer 12 because of their transparent characteristics allow a reduction in the amount of light energy needed for imaging and erasure, and additionally such semi-conductive materials have higher mechanical strengths in most instances than thin conductive layers, such as aluminum, nickel, or chromium.

The thickness of the semi-conductive layer 12 is dependent on a number of factors including the thicknesses of the other layers, economics, the amount of conductivity desired, the amount of transparency desired, and the like. While this thickness is generally represented by conductivity per square unit, that is ohms per square; for example, some of the semi-conductive materials useful in the device of the present invention have a surface resistivity of about 500 ohms per square, this layer ranges in thickness of from about 50 to about 500 Angstrom units, and preferably is of a thickness of from about 200 to about 400 Angstrom units.

The photogenerating layer 14 is comprised of photoconductive particles or pigments randomly dispersed in a resinous binder 15. Accordingly, the photoconductive composition for the photogenerating layer 14 can comprise various photoconductive charge carrier photogenerating materials known for use in xerography, providing such materials are electronically compatible with the charge carrier transport layer 16, that is, for example, the materials selected will allow the injection of photoexcited charge carriers into the transport layer 16, and allow charge carriers to travel across the interface between the photogenerating layer 14 and the charge carrier transport layer 16. Generally, the photoconductive compositions of photogenerating layer 14 are comprised of inorganic photoconductive materials, organic photoconductive materials, and the like. Illustrative examples of inorganic photoconductive materials that may be utilized include amorphous selenium and selenium alloys, such as selenium tellurium, selenium tellurium arsenic, selenium arsenic; halogen doped amorphous selenium substances, halogen doped amorphous selenium alloys; cadmium sulfoselenide; cadmium selenide; cadmium sulfide; various forms of selenium, including trigonal selenium; sodium doped selenium compositions, including sodium doped selenium alloys; mixtures thereof, and the like; with trigonal selenium being preferred.

Illustrative examples of organic photoconductive materials which may be selected for the photogenerating layer 14 include numerous known materials, such as those described in U.S. Pat. Nos. 3,357,989 and 4,265,990, the disclosures of each of these patents being totally incorporated herein by reference. Specific examples of photogenerating materials include various phthalocyanine compositions, including the X-form of metal free phthalocyanine, metal phthalocyanines, such as copper phthalocyanine; vanadyl phthalocyanines, quinacridones available from duPont under the tradename Monastral Red, Monastral Violet and Monastral Red Y; substituted 2,4-diamino-triazines reference U.S. Pat. No. 3,442,781; polynuclear aromatic quinones available from Allied Chemical Corporation under the tradename Indofast Double Scarlet, Indofast Violet Lake B, Indofast Brilliant Scarlet and Indofast Orange; known squarylium pigments; intermolecular charge transfer complexes; such as a mixture of poly(N-vinylcarbazole) and trinitrofluorenone; and the like; with vanadyl phthalocyanine being preferred.

Preferred photogenerating compositions include in addition to trigonal selenium and vanadyl phthalocyanine, a halogen doped selenium arsenic alloy, wherein the percentage of selenium by weight ranges from about 60 to about 75 percent, the percentage of arsenic by weight ranges from about 25 to about 40 percent, and the halogen, is chlorine or iodine, present in an amount of from about 200 to 900 parts per million. Other preferred photogenerating compositions include arsenic selenium alloys containing from about 0.5 percent to about 50 percent arsenic, and from about 99.5 percent to 50 percent of selenium, and a halogen material present in an amount of from about 10 parts per million to about 10,000 parts per million. The halogen materials include chlorine, bromine, and iodine, with chlorine and iodine being preferred.

Illustrative examples of resinous binder compositions 15 incorporated into the photogenerating layer generally include resinous materials which are inactive, such as those disclosed in U.S. Pat. No. 3,121,006, the disclosure of which is totally incorporated herein by reference, poly(hydroxyethers), and the like. Specific illustrative examples of resinous binder materials 15 include polyesters, polycarbonates, polyvinylcarbazole, poly(-hydroxyethers) and the like, with the preferred resinous binder material 15 being derived from diphenols, particularly bisphenols which poly(hydroxyethers) are of the following formulas:

I.

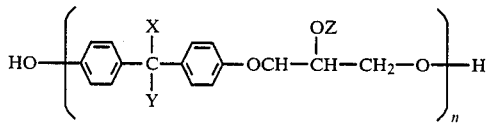

and

II.

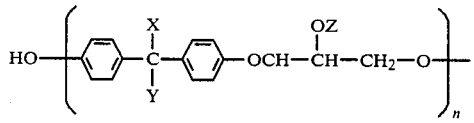

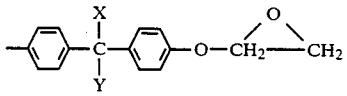

wherein X and Y are independently selected from the group consisting of aliphatic groups and aromatic groups, Z is hydrogen, an aliphatic group, or an aromatic group, a carbonyl group, a carboxyl group, a carbonate group and the like, and n is a number of from about 50 to about 200, and preferably from about 75 to about 125. These poly(hydroxyethers), some of which are commercially available from Union Carbide Corporation, are generally described in the literature as phenoxy resins, and/or epoxy resins.

Examples of aliphatic groups for the poly(hydroxyethers), include those containing from about 1 to about 30 carbon atoms, such as methyl, ethyl, propyl, butyl, pentyl, hexyl, heptyl, decyl, pentadecyl, eicodecyl, and the like. Preferred aliphatic groups include alkyl groups containing from 1 to about 6 carbon atoms such as methyl, ethyl, propyl, and butyl. Illustrative examples of aromatic groups include those containing from about 6 to about 25 carbon atoms, such as phenyl, naphthyl, anthryl and the like, with phenyl being preferred. Encompassed within the present invention are aliphatic and aromatic groups which can be substituted with various known substituents including for example, alkyl, halogen, nitro, sulfo, and the like.

Examples of the Z substiuent include hydrogen, as well as aliphatic, aromatic, substituted aliphatic and substituted aromatic groups as defined herein. Furthermore, Z can be selected from carboxyl, carbonyl, carbonate, and other similar groups, resulting in, for example, the corresponding esters, and carbonates of the poly(hydroxyethers).

Preferred poly(hydroxyethers) include those wherein X and Y are alkyl groups, such as methyl, Z is hydrogen or a carbonate group, and n is a number ranging from about 75 to about 100. Specific preferred poly(hydroxyethers) include Bakelite phenoxy(PKHH), commercially available from Union Carbide Corporation, and prepared by the reaction of 2,2-bis(4-hydroxyphenyl)-propane, or bis phenol A, with epichlorohydrin; the epoxy material commercially available from CIBA as Araldite ®6097, which is described as a solid unmodified epoxy resin; the phenylcarbonate of a poly(hydroxyether), that is wherein Z is a phenylcarbonate and the like. Other preferred poly(hydroxyethers) include those prepared from various dihydroxy alcohols and epichlorohydrins. Examples of alcohols selected for reaction include biphenols, such as dichloro bis phenol A, tetrachloro bis phenol A, tetrabromo bis phenol A, bis phenol F, bis phenol ACP, bis phenol L, bis phenol V, bis phenol S, and the like.

The photogenerating layer, containing photoconductive materials or pigments in a resinous binder generally ranges in thickness of from about 0.1 microns to about 5 microns, and preferably has a thickness of from about 0.3 microns to about 1 micron. Thickness outside these ranges can be selected for the photogenerating layer providing the objectives of the present invention are achieved.

The photogenerating composition is incorporated into the resinous binder material 15 in various suitable percentages. Generally, however, from about 10 percent to about 60 percent by volume, and preferably from about 20 percent to about 30 percent by volume of the photogenerating composition is incorporated into about 40 volume percent to about 90 volume percent, and preferably from about 70 volume percent to about 80 volume percent of the resinous binder material 15. In one variation, there can be included in the resinous binder material 15, from about 10 to about 20 volume percent of the active amine transport material as a replacement for a portion of the resinous binder composition. Addition of the transport material assists in providing for improved charge transport through the organic binder material especially for electrically non-active binder materials.

The charge carrier transport layer 16 can be comprised of numerous suitable materials which are capable of transporting holes, this layer generally having a thickness in the range of from about 5 to about 50 microns, and preferably from about 20 to about 40 microns. In one embodiment of the present invention, the transport layer is comprised of certain diamines dispersed in a suitable resinous matrix 17. The diamines are comprised of molecules of the following formula:

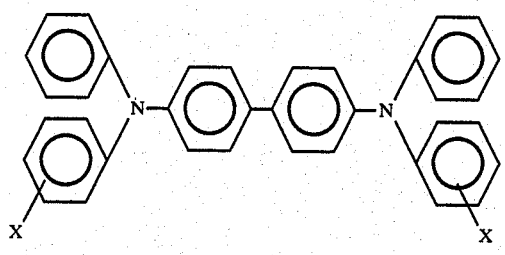

dispersed in a highly insulating and transparent organic resinous material 17, wherein X is selected from the group consisting of (ortho) $CH_3$, (meta) $CH_3$, (para) $CH_3$, (ortho) Cl, (meta) Cl, (para) Cl. This charge transport layer is substantially non-absorbing in the spectral region of intended use i.e., visible light, but is "active" in that it allows injection of photogenerated holes from the photogenerating layer 14. As indicated, the charge carrier transport material is dispersed in a resinous binder 17 which binder is generally incapable of supporting the injecting of holes from the generating layer, however, the resin becomes electrically active when it contains, for example, from about 10 to 75 weight percent of the active transporting material.

Illustrative examples of active charge transport diamines embraced by the above identified formula include N,N,N',N'-tetraphenyl[1,1-biphenyl]4-4'-diamines. Compounds corresponding to this formula thus include, for example, N,N'-diphenyl-N,N'-bis(alkylphenyl)-[1,1-biphenyl]-4,4'-diamine wherein alkyl is selected from the group consisting of methyl, such as 2-methyl, 3-methyl and 4-methyl, ethyl, propyl, butyl, hexyl and the like. With chloro substitution, the compound is N,N'-diphenyl-N,N'-bis(halo phenyl)-[1,1'-biphenyl]-4,4'-diamine, wherein halo is 2-chloro, 3-chloro or 4-chloro.

Other electrically active small molecules which can be dispersed in the electrically inactive resin to form a layer which will transport holes include triphenylmethane, bis(4-diethylamine-2-methylphenyl)phenylmethane; 4',4''-bis(diethylamino)-2'2''-dimethyltriphenyl methane; and the like.

The resinous binder material 17 can be comprised of various electrically inactive binder substances, including those described in U.S. Pat. No. 3,121,006, the disclosure of which is totally incorporated herein by reference, such as polycarbonates, acrylate polymers, vinyl polymers, cellulose polymers, polyesters, polysiloxanes, polyamides, polyurethanes, block, random or alternating copolymers thereof, and the like. Additionally, the binder resinous material 17 can be comprised of the poly(hydroxyethers), esters and carbonates as illustrated hereinbefore with respect to the resinous binder layer 15 for the photogenerating layer. Accordingly, the resinous binder layers for the transport and generating layer in one preferred embodiment of the present invention can be comprised of the identical poly(hydroxyethers) specified hereinbefore.

Another preferred binder material 17 is comprised of polycarbonate resins having a molecular weight of from 20,000 to about 100,000, with a molecular weight in the range of from about 50,000 to about 100,000 being particularly preferred. An example of such a polycarbonate resin is available as Makrolon®, which has dispersed therein about 40 to about 50 percent by weight of the diamine charge transport layer of the present invention.

The charge transport material can be incorporated into the resinous binder composition 17 in various amounts providing the objectives of the present invention are achieved, however, generally from about 5 percent by weight to about 75 percent by weight of the charge transport material, and preferably from about 40 percent by weight to about 50 percent by weight of the charge transport material is incorporated into the resinous binder composition 17, which in this embodiment is present in an amount of from about 25 percent by weight to about 90 percent by weight, and preferably from about 50 percent by weight to about 60 percent by weight.

Figure 2:
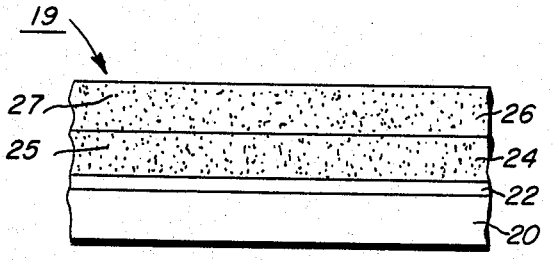
FIG. 2 is a partially schematic cross-sectional view of a preferred photoresponsive imaging device of the present invention.

One preferred photoresponsive imaging device of the present invention is illustrated in FIG. 2, designated generally as 19 and containing an insulating Mylar® substrate 20, in a thickness of 75 microns, a transmissive indium-tin oxide semi-conductive layer 22, 100 Angstroms in thickness (500 ohms/square), a photogenerating layer 24 of trigonal selenium, 0.5 microns in thickness, 50 percent by weight, dispersed in 50 percent by weight of the poly(hydroxyether) commercially available as Bakelite PKHH, from Union Carbide, and as the transport layer 26, 25 microns in thickness, 50 percent by weight of N,N'-diphenyl-N,N'-bis(3-methylphenyl)-[1,1'-biphenyl]-4,4'-diamine, dispersed in 50 percent by weight of a polycarbonate binder 27, available as Makrolon®.

Figure 3:
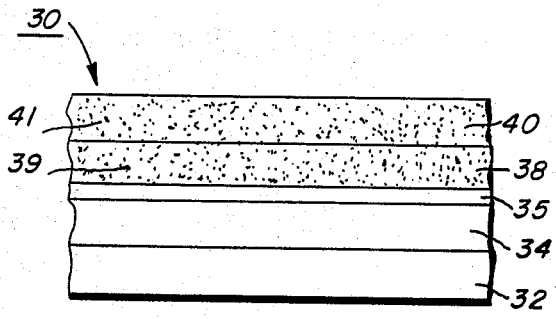
FIG. 3 is a partially schematic cross-sectional view of another preferred photoresponsive imaging device of the present invention.

A further embodiment of the present invention, is illustrated in FIG. 3 wherein there is included in the photoresponsive device as an optional layer, a dielectric layer 35 containing various dielectric materials including silicon oxides, aluminum oxides, and the like as disclosed hereinbefore. This layer ranges in thickness of from about 0.01 micron to about 1 micron, although thicknesses outside these ranges can be selected providing the objectives of the present invention are achieved.

More specifically with regard to FIG. 3, there is illustrated a photoresponsive device generally designated 30, comprised of a supporting substrate 32 of Mylar, in a thickness of 75 microns, layer 34 comprised of a semi-conductive indium-tin oxide in a thickness of about 100 Angstrom units, layer 35 comprised of a dielectric material of silicon oxide, in a thickness of about 1 micron, photogenerating layer 38 containing trigonal selenium, 33 percent by volume, dispersed in 39, 67 percent by volume of a poly(hydroxyether) commercially available as Bakelite PKHH from Union Carbide, this layer having a thickness of 0.5 microns, and a transport layer 40, of a thickness of 25 microns, containing 40 percent by weight of N,N'-diphenyl-N,N'-bis(3-methylphenyl)-[1,1'-biphenyl]-4,4'-diamine dispersed in 60 percent by weight of a polycarbonate resin 41, commercially available as Makrolon®.

Figure 4:
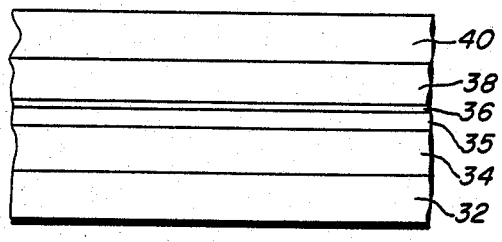
FIG. 4 is a partially schematic cross-sectional view of a photoresponsive imaging device of the present invention containing an optional dielectric layer and an optional adhesive layer.

Illustrated in FIG. 4 is essentially the same photoresponsive device as described with regard to FIG. 3, with like reference numerals representing like materials with the exception that the photoresponsive device of FIG. 4 includes as a further additional layer an adhesive layer 36, in a thickness of 0.1 microns. The adhesive layer is generally applied by known means for example, by solvent coating, prior to depositing the photogenerating layer thereon.

The photoresponsive imaging devices of the present invention can be prepared by various known methods, as described for example, in U.S. Pat. No. 4,265,990, the disclosure of which has been previously totally incorporated herein by reference. In one illustrative preparation sequence, the photogenerating pigment such as trigonal selenium, and the resinous binder material, such as the poly(hydroxyether), are mixed in a solvent of methyl ethyl ketone and cellosolve acetate for the purpose of obtaining small particle sizes of trigonal selenium, ranging from about 0.1 to about 0.5 microns. Mixing is accomplished until the desired particle size trigonal selenium is obtained, approximately 1 to 3 days, and subsequently, the resulting trigonal selenium dispersion is coated with a Bird applicator on a semi-conductive layer, such as indium-tin oxide, subsequent to coating of the oxide on a supporting substrate, which coating is dried at about 135° C. for about 5 minutes. The transport layer can then be coated by known means, such as solution coating on the photogenerating layer, followed by drying at 135° C. for about 5 minutes.

The photoresponsive device of the present invention can be incorporated in xerographic imaging systems well known in the art. An electrostatic latent image is formed on the device, followed by development of the image with developer particles containing toner and carrier particles; followed by subsequently transferring the image to a permanent substrate, and optionally affixing the image thereto by heat. The image may be developed by any well known xerographic development techniques including, for example, cascade, magnetic brush development, and the like. The visible image is typically transferred to a receiver member by any conventional transfer technique and affixed thereto. While it is preferable to develop the electrostatic latent image with marking material the image may be used in a number of other ways such as, for example, "reading" the latent image with an electrostatic scanning system.

When the photoresponsive device of the present invention is to be reused to make additional reproductions in a recyclible xerographic apparatus, any residual charge remaining on the photoreceptor after the visible image has been transferred to a receiver member is typically removed therefrom prior to each repetition of the cycle, as is any residual toner material remaining after the transfer step. Generally, the residual charge can be removed from the device by ionizing the air above the electrically insulating overcoating of the photoreceptor, while the photogenerating layer is uniformly illuminated and grounded.

The invention will now be described in detail with respect to specific preferred embodiments thereof, it being understood that these Examples are intended to be illustrative only and the invention is not intended to be limited to the materials, conditions, process parameters, recited herein. All parts and percentages are by weight unless otherwise indicated.

The highly transparent semi-conductive layers specified in the working examples have a resistivity of about 500 ohms per square, however, materials of other resistivities can be used providing the objectives of the present invention are satisfied. Thus, materials having resistivities ranging from about 3 ohms per square to up to 1,000 ohms per square are useful for incorporation into the photoresponsive imaging device of the present invention.

EXAMPLE I

There was prepared in the following manner as a photogeneraing layer, 0.5 microns in thickness, a dispersion of trigonal selenium in a resinous poly(hydroxyether), binder.

There was charged into a 4 oz. bottle 17.0 milliliters of methyl ethyl ketone (MEK), 7.7 milliliters of methyl cellosolve acetate (MEA), 1.6 grams of a poly(hydroxyether), available from Union Carbide as Bakelite phenoxy PKHH, 3.3 grams of a trigonal selenium powder, and 200 grams of stainless steel shot. The mixture was mixed by rolling for 4 days resulting in a dispersion containing 30 volume percent of trigonal selenium particles, about 0.1 microns in diameter and 70 volume percent of the phenoxy resin PKHH.

EXAMPLE II

A second dispersion was prepared by adding to 1.5 grams of the dispersion prepared in Example I, 0.025 grams of N,N'-diphenyl-N,N'-bis(3-methylphenyl)1,1'-biphenyl-4,4'-diamine, and 25 grams of tetrahydrofuran). These ingredients were mixed for about 24 hours in a 4 dram vial.

EXAMPLE III

A third dispersion was prepared by charging into a 4 ounce glass bottle 7.0 milliliters of methylethyl ketone, 21 milliliters of toluene, 1.6 grams of a poly(hydroxyether), commercially available from CIBA as Araldite 6097 epoxy, a solid unmodified resin, 2.70 grams of a trigonal selenium powder, and 200 grams of stainless steel shot. The mixture was then milled for 4 days resulting in a dispersion containing trigonal selenium particles, 0.1 micron in diameter, 33 percent by volume, in an epoxy resinous binder polymer solution 67 percent by volume.

EXAMPLE IV

A fourth dispersion was prepared by charging into a 4 ounce glass bottle 14 milliliters of toluene, 14 milliliters of tetrahydrofuran, 1.6 grams of a polyvinylcarbazole, 1.6 grams of sodium doped (100 ppm) trigonal selenium powder, and 200 grams of stainless steel shot. The mixture was then roll milled for 5 days resulting in a dispersion, 20 percent by volume, of sodium doped trigonal selenium particles, 0.1 microns in diameter in polyvinylcarbazole polymer solution, 80 percent by volume.

EXAMPLE V

There was prepared two adhesive solutions as follows:

(A)—poly(vinylpyrrolidone) adhesive solution—there was dissolved by stirring in a mixture of 90 milliliters of ethanol and 10 milliliters of butanol, 0.5 grams of polyvinylpyrrolidone.

(B)—polyester adhesive solution—there was dissolved by stirring in mixture of 20 grams of 1,1,2,trichloroethane, and 80 grams of methylene chloride, 0.50 grams of a polyester commercially available from E. I. duPont as 49,000 polyester, resulting in a polyester adhesive solution.

EXAMPLE VI

There was prepared a photoresponsive device by first coating with a Bird applicator a highly transmissive semi-conductive material of indium tin oxide, 300 Angstroms in thickness, on a polyester substrate, of a thickness of 3 mils. Subsequently, there was coated on the indium tin oxide, with a 0.0005 inch Bird applicator, a photogenerating layer containing a dispersion of trigonal selenium particles in the poly(hydroxyether) PHKK, which dispersion resulted from the process of Example I. The resulting device was dried for 15 minutes at 135° C., resulting in a photogenerating layer having a thickness of 0.5 microns.

Subsequently, there was overcoated on the photogenerating layer, by solvent dispersion, a charge carrier transport layer solution, containing 7.35 grams of N,N'-diphenyl-N,N'-bis(3-methyl)1,1'-biphenyl-4,4'-diamine, and 7.35 grams of the polycarbonate resinous material, commercially available as Makrolon, dissolved in 8.53 grams of methylene chloride, which overcoating was accomplished with 0.005 inch Bird applicator. The resulting charge transport layer was dried at 100° C. for 5 minutes, and then at 135° C. for 5 minutes, resulting in a thickness for this layer of 25 microns.

The resulting photoresponsive device thus containing the following layers in the order indicated: (1) a polyester supporting substrate, (2) a conductive indium tin oxide layer, (3) a photogenerating layer, 0.5 microns in thickness, containing trigonal selenium, 30 percent by volume, dispersed in 70 percent by volume of the phenoxy resinous binder PKHH, and (4) a charge transport layer of the diamine indicated dipsersed in a polycarbonate binder, 50 percent by weight of the diamine and 50 percent by weight of the polycarbonate.

EXAMPLE VII

A photoresponsive device was prepared by repeating the procedure of Example VI with the exception that prior to depositing the photogenerating layer there was deposited on the semi-conductive indium tin oxide layer, a dielectric layer of silicon dioxide, 150 Angstroms in thickness, by vacuum depositing of silicon in a low pressure of oxygen gas.

There thus resulted a photoresponsive device containing the following layers in the order specified: (1) a polyester supporting substrate, (2) a transmissive semi-conductive indium tin oxide layer, (3) a silicon dioxide dielectric layer, (4) a photogenerating layer, containing trigonal selenium, dispersed in the phenoxy resinous binder PKHH, and (5) a charge carrier transport layer containing the diamine of Example VI dispersed in a polycarbonate resinous binder.

EXAMPLE VIII

A photoresponsive device was prepared by coating on a polyester substrate, 3 mils thickness, a semi-conductive layer of titanium silicide, 300 Angstroms in thickness. Subsequently 4.5 grams of the dispersion of trigonal selenium contained in the epoxy resinous binder Araldite 6097, prepared in accordance with Example III, was mixed with 3.0 grams of methylethylketone. The resulting mixture was coated with a 0.001 inch Bird applicator, on the titanium silicide semi-conductive layer, followed by drying at 135° C. for 5 minutes.

There resulted a photogenerating layer, containing trigonal selenium, about 30 percent by volume, and epoxy resin, about 70 percent by volume, in a thickness of 0.7 microns.

Subsequently, there was coated on the above photogenerating layer with a 0.005 inch Bird applicator, a transport layer solution containing 7.35 grams (50 percent by weight) of the polycarbonate material commercially available as Makrolon and 7.35 grams (50 percent by weight) of N,N'diphenyl-N,N'-bis(3-methyl)1,1'-biphenyl-4,4'-diamine, dissolved in 85.3 grams of methylene chloride. The resulting layer was then dried at 100° C. for 5 minutes, and dried at 135° C. for 5 minutes.

There thus resulted a photoresponsive device containing the following layers in the order specified: (1) a polyester supporting substrate, (2) a titanium silicide semi-conductive layer, (3) a photogenerating layer, containing trigonal selenium, dispersed in an epoxy resinous binder, containing 33 volume percent of trigonal selenium and 67 volume percent of the epoxy resinous binder, and (4) a charge transport layer containing the diamine indicated dispersed in a polycarbonate solution.

EXAMPLE IX

There was prepared a photoresponsive device by coating with a Bird applicator, on a polyester support substrate, 3 mils thickness, a titanium silicide semi-conductive layer, 300 Angstroms in thickness, followed by coating on the semi-conductive layer a polyester adhesive solution prepared in accordance with Example IV (B), using a 0.0005 inch Bird applicator, followed by drying at 100° C. for 5 minutes. There resulted an adhesive layer of a thickness of 0.1 microns.

The resulting adhesive layer was then overcoated with the photogenerating layer of the trigonal selenium polyvinylcarbazole dispersion prepared in accordance with Example VI, using a 0.0005 inch Bird applicator, followed by drying at 130° C. for 5 minutes. There thus resulted a photogenerating layer having a thickness of 0.5 microns.

Subsequently, there was coated with a 0.005 inch Bird applicator on the above photogenerating layer a transport layer solution containing 7.35 grams of the polycarbonate commercially available as Makrolon, and 7.35 grams of N,N'diphenyl-N,N'-bis(3-methyl)1,1'-biphenyl-4,4'-diamine, dissolved in 85.3 grams of methylene chloride. The resulting layer was then dried at 100° C. for 5 minutes, and dried at 135° C. for 5 minutes. There resulted a charge transport layer having a thickness of 25 microns.

The resulting photoresponsive device contained the following layers in the order indicated: (1) a polyester support substrate, (2) a titanium silicide semi-conductive layer, (3) a polyester adhesive layer (4) a photogenerating layer, 0.5 microns in thickness, containing trigonal selenium, dispersed in polyvinylcarbazole, and (5) a charge carrier transport layer containing the diamine indicated dispersed in a polycarbonate resin.

EXAMPLE X

A photoresponsive device was prepared by repeating the procedure of Example IX with the exception that the semi-conductive layer titanium nitride, 300 Angstroms in thickness, is substituted for the titanium silicide semi-conductive layer.

There thus resulted a photoresponsive device containing the following layers in the order specified: (1) a polyester supporting substrate, (2) a titanium nitride semi-conductive layer, (3) a polyester adhesive solution, (4) a photogenerating layer, 0.5 microns in thickness, containing trigonal selenium, dispersed in polyvinylcarbazole, and (5) a charge transport layer containing the diamine indicated dispersed in a polycarbonate resin.

EXAMPLE XI

There was prepared a photoresponsive device by coating with a Bird applicator on a polyester support substrate, 3 mils in thickness, a semi-conductive layer of cadmium tin oxide, 300 Angstroms in thickness, which oxide had a conductivity of 4,000 ohms/square. The semi-conductive layer was then overcoated with the polyvinylpyridone adhesive solution prepared in accordance with Example V(A) which coating was accomplished with a 0.0005 inch Bird applicator, followed by drying at 100° C. for 5 minutes.

There resulted an adhesive layer having a thickness of 0.1 microns.

There was then overcoated on the cadmium tin oxide semi-conductive layer, the photogenerating layer prepared in accordance with Example IV, containing a dispersion of trigonal selenium, and polyvinylcarbazole, which coating was accomplished with a 0.0005 inch Bird applicator, followed by drying at 135° C. for 5 minutes. There resulted a photogenerating layer having a thickness of 0.5 microns.

Subsequently, there was overcoated on the above photogenerating layer a transport layer solution containing 7.35 grams of the polycarbonate material commercially available as Makrolon and 7.35 grams of N,N'diphenyl-N,N'-bis(3-methyl)1,1'-biphenyl-4,4'-diamine, dissolved in 85.3 grams of methylene chloride, with a 0.005 inch Bird applicator, followed by drying at 100° C. for 5 minutes, and then drying at 135° C. for 5 minutes. The resulting transport layer had a thickness of 25 microns.

EXAMPLE XII

A photoresponsive device was then prepared by repeating the procedure of Example XI with the exception that there was overcoated with a Bird applicator, on the cadmium tin oxide semi-conductive layer, an aluminum oxide dielectric layer, 100 Angstroms in thickness. There was then coated on the aluminum oxide layer the polyester adhesive solution prepared in accordance with Example V(B), using a 0.0005 inch Bird applicator, followed by drying at 100° C. for 5 minutes. There resulted an adhesive layer of a thickness of 0.1 microns.

There was then coated on the resulting adhesive layer a photogenerating layer containing a dispersion of trigonal selenium in polyvinylcarbazole prepared in accordance with Example IV, using a 0.0005 inch Bird applicator, followed by drying at 130° C. for 5 minutes. There resulted a photogenerating layer having a thickness of 0.5 microns. Subsequently, there was overcoated on the above photogenerating layer a transport layer solution containing 7.35 grams, 50 percent by weight, of the polycarbonate material commercially available as Makrolon, and 7.35 grams, 50 percent by weight, of N,N'diphenyl-N,N'-bis(3-methyl)1,1'-biphenyl-4,4'-diamine, dissolved in 85.3 grams of methylene chloride, with a 0.005 inch Bird applicator. The resulting layer was then dried at 100° C. for 5 minutes, and then dried at 135° C. for 5 minutes. The resulting charge transport layer had a thickness of 25 microns.

EXAMPLE XIII

A photoresponsive device was prepared by repeating the procedure of Example XII with the exception that there was selected as the photogenerating layer vanadyl phthalocyanine, 40 percent by volume, dispersed in 60 percent by volume of the phenoxy resinous binder, PHKK.

EXAMPLE XIV

The photoresponsive devices as prepared in Examples VI–XII were then tested for photoconductivity in the following manner:

The semi-conductive layer of each of the photoresponsive devices was shorted to ground potential. Each of the photoresponsive devices prepared were then charged in the dark to about −1,000 volts with a pin corotron. The surface potential of each photoresponsive device was continuously monitored with an electrometer probe, for the purpose of determining the decay of the surface potential in the dark. The photoresponsive devices where then recharged to −1,000 volts. After about 0.15 seconds, each of the photoresponsive devices was exposed to 5 ergs/cm$^2$ of broad band white light. The surface potential of each of the photoresponsive devices was then measured on a electrometer and the measurements stored in a computer, 0.5 seconds after each exposure.

The percent discharge of the surface potential due to the light exposure measures the photoconductivity of the device.

The ratio of the surface potential after exposure of each of the photoresponsive devices to light to the surface potential of each of the photoresponsive devices in the dark, is a measure of the photoconductivity of each device. The percent discharge is calculated as being 1 minus this ratio multiplied by 100. For example, if the potential in the dark is −814 volts, and the potential after exposure to light is −222 volts, the percent discharge is 73 percent.

The following data resulted from these tests for the photoresponsive devices indicated:

| Example No. | Percent Discharge | Dark No. (volts) | Light No. (volts) |
|---|---|---|---|
| VI | 73 | −814 | −222 |
| VII | 96 | −832 | −35 |
| VIII | 95 | −709 | −36 |
| IX | 92 | −576 | −47 |
| X | 84 | −128 | −20 |
| XI | 58 | −720 | −300 |
| XII | 75 | −824 | −108 |

The percent discharge represents the amount of charge lost as a result of the light exposure, thus for the photoresponsive device of Example VI, 73 percent of the charge was lost, indicating that this device had photoconductivity and was capable of forming electrostatic latent images. Further for this example, the number 814 represents the charge in volts that the photoresponsive device held in the dark, while the number 222 represents the amount of charge in volts the photoresponsive device held in the light. The difference in these two values represents the degree of photoconductivity of the device involved.

Although the invention has been described with reference to specific preferred embodiments, it is not intended to be limited thereto, rather those skilled in the art will recognize variations and modifications may be made therein which are within the spirit of the invention and within the scope of the following claims.

The disclosure of copending application U.S. Ser. No. 420,961, filed Sept. 21, 1982, is totally incorporated herein by reference.

We claim:

1. An improved layered photoresponsive device comprised of (1) a substrate, (2) a transmissive semi-conductive layer selected from the group consisting of indium-tin oxide, tin oxide, titanium oxides, titanium nitrides, titanium silicides, cadmium tin oxides, and mixtures thereof, (3) a photogenerating layer comprised of an inorganic photoconductive composition or an organic photoconductive composition, dispersed in a resinous binder, and (4) a charge carrier transport layer comprised of a resinous binder having dispersed therein small molecules of an electrically active material, the combination of which is substantially non-absorbing to visible light and allows the injection of photogenerating holes from the charge photogenerating layer in contact therewith, the electrically active material being of the following formula:

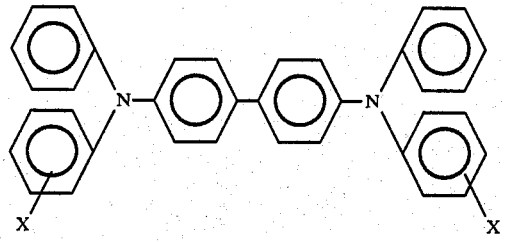

wherein X is selected from the group consisting of (ortho), $CH_3$, (meta), $CH_3$, (para), $CH_3$, (ortho), Cl, (meta) Cl, and (para), Cl.

2. A layered photoresponsive imaging device in accordance with claim 1 wherein the thickness of the substrate is from about 25 microns to about 200 microns, the thickness of the semiconductive layer is from about 50 Angstrom units to about 500 Angstrom units, the thickness of the generating layer is from about 0.1 micron to about 5.0 microns and the thickness of the transport layer is from 5 microns to about 50 microns.

3. An improved layered photoresponsive device in accordance with claim 2 wherein the semi-conductive layer is indium-tin oxide.

4. An improved layered photoresponsive device in accordance with claim 1 wherein the substrate is comprised of an insulating composition, or a conductive composition.

5. An improved layered photoresponsive device in accordance with claim 4 wherein the insulating composition is a polymeric material.

6. An improved layered photoresponsive device in accordance with claim 1 wherein the photogenerating layer is comprised of inorganic photoconductive compositions or organic photoconductive compositions.

7. An improved photoresponsive device in accordance with claim 6 wherein the inorganic photoconductive compositions are selected from selenium, a selenium alloy, halogen doped selenium substances, or halogen doped selenium alloys.

8. An improved photoresponsive device in accordance with claim 7 wherein the photogenerating material is a selenium arsenic alloy, or a selenium tellurium alloy, doped with chlorine.

9. An improved photoresponsive device in accordance with claim 6 wherein the photogenerating material is a trigonal selenium.

10. An improved photoresponsive device in accordance with claim 6 wherein the organic photogenerating composition is comprised of metal phthalocyanines, metal free phthalocyanines, or vanadyl phthalocyanine.

11. An improved layered photoresponsive device in accordance with claim 1 wherein the resinous binder material for the photogenerating layer is of the formulas

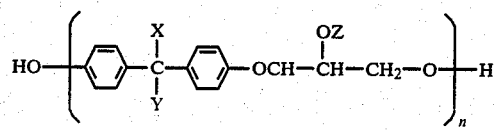

or

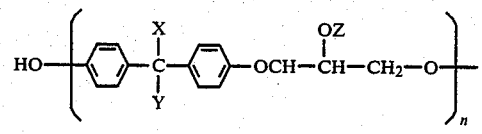

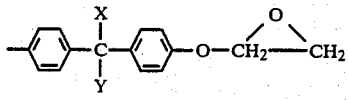

wherein X and Y are independently selected from the group consisting of aliphatic groups and aromatic groups, Z is hydrogen, carboxyl, carbonyl or carbonate, and n is a number of from about 50 to about 200.

12. An improved photoresponsive device in accordance with claim 11 wherein X and Y are aliphatic groups containing from 1 to about 6 carbon atoms, Z is hydrogen, and n is 100.

13. An improved photoresponsive device in accordance with claim 11 wherein from about 10 percent by volume to about 60 percent by volume of the photoconductive composition is incorporated into about 40 percent by volume to about 90 percent by volume of the poly(hydroxyether) binder material.

14. An improved photoresponsive device in accordance with claim 11 wherein there is included in the poly(hydroxyether) resinous binder in an amount of from about 10 percent by volume to about 20 percent by volume a charge transport material.

15. An improved photoresponsive device in accordance with claim 1 wherein the active charge carrier transport material is N,N'-diphenyl-N,N'-bis(3-methylphenyl)-[1,1'-biphenyl]-4,4'-diamine.

16. An improved photoresponsive device in accordance with claim 1 wherein the active charge transport material is dispersed in a resinous binder comprised of polycarbonates, or polyhydroxyether compositions of the following formulas:

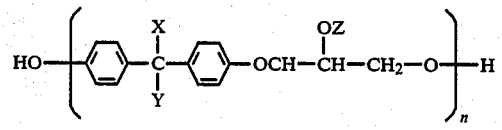

and

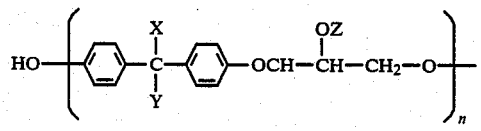

-continued

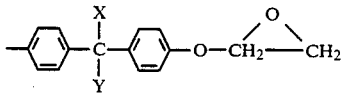

wherein X and Y are independently selected from the group consisting of aliphatic groups and aromatic groups, Z is hydrogen, carboxyl, carbonyl or carbonate, and n is a number of from about 50 to about 200.

17. An improved photoresponsive device in accordance with claim 16 wherein X and Y are alkyl groups containing from about 1 to about 6 carbon atoms, Z is hydrogen, and n is 100.

18. An improved photoresponsive device in accordance with claim 16 wherein about 50 percent by weight of the active charge transport material is incorporated into about 50 percent by weight of the poly(hydroxyether).

19. An improved photoresponsive device in accordance with claim 1 wherein the transmissive semi-conductive layer is indium-tin oxide.

20. An improved photoresponsive device in accordance with claim 1 wherein there is situated between the semi-conductive and photogenerating layer, a dielectric material.

21. An improved photoresponsive device in accordance with claim 20 wherein the dielectric layer is comprised of aluminum oxide, or silicon oxide.

22. An improved photoresponsive device in accordance with claim 1 wherein, the semiconductive transmissive layer is indium-tin oxide, the substrate is a polymeric composition, the photogenerating layer is comprised of trigonal selenium dispersed in a poly(hydroxyether) resinous polymer, and the charge transport layer is comprised of N,N'-diphenyl-N,N'-bis(3-methylphenyl)-[1,1'-biphenyl]-4,4'-diamine, dispersed in a polycarbonate resinous binder.

23. A photoresponsive device in accordance with claim 1 wherein, the substrate is comprised of polymeric material, the semiconductive layer is comprised of indium-tin oxide, the photogenerating layer is comprised of trigonal selenium dispersed in a poly(hydroxyether) resinous binder, the charge transport layer is comprised of N,N'-diphenyl-N,N'-bis(3-methylphenyl)-[1,1'-biphenyl]-4,4'-diamine dispersed in a polycarbonate resin and there is further included in the device, a dielectric material of silicone dioxide situated between the semiconductive indium-tin oxide layer and the photogenerating layer.

24. A method of imaging which comprises forming an electrostatic latent image on the photoresponsive device of claim 1, subsequently developing this image with toner particles, followed by transferring the developed image to a suitable substrate, optionally permanently affixing the image thereto.

25. A method of imaging in accordance with claim 24 wherein, the resinous binder for the photogenerating material is a polyhydroxyether composition.

26. A method of imaging in accordance with claim 24 wherein, the resinous binder for the transport molecule is a polyhydroxyether, or a polycarbonate resin.

27. A method of imaging in accordance with claim 24 wherein, the semiconductive layer is indium-tin oxide, and the substrate is a polymeric composition.

28. A method of imaging in accordance with claim 24 wherein, the photogenerating layer is comprised of inorganic photoconductive compositions selected from the group consisting of selenium, selenium alloys, halogen doped selenium substances, and halogen doped selenium alloys.

29. A method of imaging in accordance with claim 24 wherein, the photogenerating material is trigonal selenium.

30. A method of imaging in accordance with claim 24 wherein, the organic photogenerating composition is comprised of metal phthalocyanines, metal free phthalocyanines, or vanadyl phthalocyanine.

31. A method of imaging in accordance with claim 28, wherein the selenium alloy is comprised of selenium and tellurium.

32. An improved layered photoresponsive imaging member consisting essentially of (1) a conductive supporting substrate, (2) a transmissive semiconductive layer selected from the group consisting of indium-tin oxide, titanium oxides, titanium nitrides, titanium silicides, and cadmium tin oxides, (3) a photogenerating layer comprised of an inorganic photoconductive composition or an organic photoconductive composition, dispersed in a resinous binder; and (4) a charge carrier transport layer comprised of a resinous binder having dispersed therein small molecules of an electrically active material, which layer is substantially non-absorbing to visible light and allows the injection of photogenerating holes from the charge photogenerating layer in contact therewith, the electrically active material being of the formula:

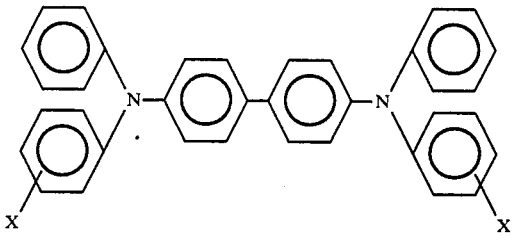

wherein X is selected from the group consisting of (ortho), $CH_3$, (meta), $CH_3$, (para), $CH_3$, (ortho), Cl, (meta), Cl, and (para), Cl.

33. An imaging member in accordance with claim 32 wherein the transmissive semiconductive layer is indium-tin oxide.

34. An imaging member in accordance with claim 32 wherein the substrate is aluminum.

35. An imaging member in accordance with claim 32 wherein the substrate is aluminum and the transmissive semiconductive layer is indium-tin oxide.

36. An imaging member in accordance with claim 32 wherein the inorganic photoconductive composition is comprised of a selenium component.

37. An imaging member in accordance with claim 36 wherein the selenium component is selected from the group consisting of amorphous selenium and selenium alloys.

38. An imaging member in accordance with claim 36 wherein the selenium component is trigonal selenium.

* * * * *